United States Patent [19]

Mourier

[11] Patent Number: 4,563,615

[45] Date of Patent: Jan. 7, 1986

[54] ULTRA HIGH FREQUENCY RADIO ELECTRIC WAVE GENERATORS

[75] Inventor: Georges Mourier, Le Port Marly, France

[73] Assignee: Thomson-CSF, Paris, France

[21] Appl. No.: 595,993

[22] Filed: Apr. 2, 1984

[30] Foreign Application Priority Data

Apr. 6, 1983 [FR] France ..... 83 05603

[51] Int. Cl.[4] ..... H01J 25/34

[52] U.S. Cl. ..... 315/39.3; 315/3.6; 315/5.33

[58] Field of Search ..... 315/39.3, 5.0, 533, 315/5.34, 3.6

[56] References Cited

U.S. PATENT DOCUMENTS

| | | | |
|---|---|---|---|
| 2,774,913 | 12/1956 | Charles | 315/39.3 |
| 2,890,037 | 6/1950 | Rendel | 165/26 |
| 2,924,741 | 2/1960 | Alfven | 315/5.26 |
| 3,189,785 | 6/1965 | Kluver | 315/39.3 |
| 3,271,618 | 9/1966 | Kooyers | 315/39.3 |
| 3,378,718 | 4/1968 | Osepchuk | 313/3.5 |
| 3,504,222 | 3/1970 | Fukushima | 315/3.0 |
| 4,207,495 | 6/1980 | McDowell | 315/39.3 |

FOREIGN PATENT DOCUMENTS 1364531 8/1974 United Kingdom .

*Primary Examiner*—Harold Dixon

*Attorney, Agent, or Firm*—Roland Plottel

[57] ABSTRACT

An electron gun of the type comprising two electrodes facing each other and brought to different potentials so as to create therebetween a continuous electric field and a cathode positioned in the extension of the electrode at negative or zero potential and brought to the same potential as this latter, the assembly being subjected to a magnetic field perpendicular to the electric field. In the plane perpendicular to the magnetic field, at least one of said electrodes has a divergent profile so that the distance between electrodes increases from the cathode towards the outside of the gun.

6 Claims, 4 Drawing Figures

ULTRA HIGH FREQUENCY RADIO ELECTRIC WAVE GENERATORS

BACKGROUND OF THE INVENTION

1. Field of the Invention

The present invention relates to an electron gun for radio electric wave generators for ultra high frequencies. It relates more particularly to an electron gun delivering an electron beam propagating along cycloidal paths for use in ultra high frequency generators of the cyclotronic resonance maser type.

2. Description of the Prior Art

In generators called cyclotronic resonance masers such as gyrotrons, an electron beam coming from an electron gun is propagated along helical paths which being guided by a uniform magnetic field directed along the axis of the helix. The beam then passes through an electromagnetic cavity resonating at a frequency $f_o$ close to a multiple of the cyclotronic frequency, in which cavity the transverse velocity components of the electrons interact with a transverse electric field component of the wave for giving up their energy thereto. In this case, the beam is essentially propagated parallel to the magnetic field. Now, since the interaction takes place with the transverse velocity component $v\perp$ of the electrons, the parallel velocity component $v\,||$ corresponds then to unused energy. Attempts have therefore been made to eliminate this parallel velocity by proposing a new type of cyclotronic resonance maser using the same interaction between the electrons rotating in a magnetic field and a resonating cavity as the one used in masers of the prior art but characterized by the fact that the velocity of the electrons parallel to the magnetic field is zero or substantially zero throughout the maser whereas a drift velocity exists perpendicular to the magnetic field due to a continuous electric field in the electron gun and the resonating structure.

In this case, however, electron guns of the type comprising a conical cathode and a conical coaxial anode subjected to an axial magnetic field, used in cyclotronic resonance masers such as gyrotrons, are not suitable.

SUMMARY OF THE INVENTION

Consequently, the aim of the present invention is an ultra-high frequency wave generator which includes a new type of electron gun capable of supplying an electron beam propagating along a cycloidal path in a transverse magnetic field under the effect of a drift velocity due to a continuous electric field.

In particular, the invention is an ultra-high frequency wave generator which includes an electron gun and a collector between which is to be propagated an electron beam along cycloidal paths in a transverse magnetic field and a resonant structure intermediate between the gun and the collector to be traversed by the electron beam characterized in that the electron gun comprises a cathode, and first and second electrodes positioned opposite one another for defining a space therebetween for flow of the electron beam, said electrodes being shaped to provide a steady increase in said space, said cathode being positioned essentially as an extension of the first electrode at its end of minimum spacing from the second electrode.

In the preferred embodiment, the first electrode and the cathode are maintained at the same ground potential, and the second electrode is maintained at a positive potential thereto.

Various profiles for the first and second electrodes are possible, consistent with the invention as will be discussed in more detail below.

BRIEF DESCRIPTION OF THE DRAWINGS

Other features and advantages of the present invention will appear from the following description of different embodiments made hereafter with reference to the accompanying drawings in which.

In the Figures, the same references refer to the same elements but for the sake of clarity, the dimensions and proportions have not been respected.

DESCRIPTION OF THE PREFERRED EMBODIMENTS

Figure 1:
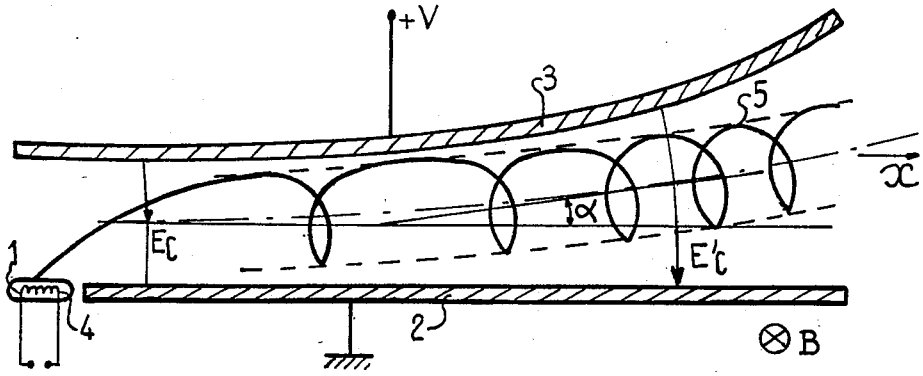
FIG. 1 is an axial schematical sectional view, in the plane perpendicular to the magnetic field, of a first embodiment of an electron gun for use with the invention.

As shown in FIG. 1, the electron gun which is a feature of the present invention is formed by cathode 1 and by two electrodes 2, 3 brought to different potentials so as to create between these two electrodes 2, 3 a continuous electric field $\overline{E}_c$. More specifically, electrode 2 called sole is brought to a negative or zero potential whereas electrode 3 called anode is brought to a positive potential V. Furthermore, cathode 1 is situated in the extension of sole 2 and is brought to the same potential as this electrode. This cathode 1 comprises for example a filament 4 connected to a voltage so as to obtain, during heating of the cathode, the emission of electrons.

In accordance with the present invention, one of the electrodes, namely the anode 3 in the embodiment shown in FIG. 1, has a curved profile so that the distance between electrodes 2, 3 increases from the cathode 1 towards the outside of the gun, namely in direction x.

The two electrodes may be formed from copper plates one of which has been suitably shaped. As explained hereafter in greater detail, preferably, the profile of the curved electrode is chosen so that the angle $\alpha$ which said profile forms with the median plane of the electrodes is such that the distance between the two electrodes varies little over a length corresponding to twice Larmor's radius $r_L$. Furthermore, the electron gun assembly is subjected to a uniform magnetic field $\overline{B}$ perpendicular to the plane of the Figure a few lines of force of which have been shown by crosses. This magnetic field is created, for example, from two superconducting coils positioned on each side of electrodes 2, 3 according to Helmholz's rule. For the sake of simplicity, these coils have not been shown in the drawings.

As explained in great detail hereafter, under the combined action of the continuous electric field $\overline{E}_c$ decreasing progressively from the cathode towards the outside of the gun because of the profile of the electrodes, and of the transverse and uniform magnetic field $\overline{B}$, the electrons emitted by cathode 1 are caused to follow a cycloidal path 5 with a drift velocity $v_d$ such that $$v_d = \frac{\overline{E}_c}{\overline{B}}.$$

It is known in fact that an electron moving in a magnetic field $\overline{B}$ and subject to the action of an electric field $\overline{E}$ comes under the influence of the force $\overline{F}$ given by Lorentz's formula, namely the following vectorial equation:

$$\overline{F}=q(\overline{E}+\overline{v}\times\overline{B})$$

let us then consider a velocity $v_d$ such that $$\overline{E}+\overline{v}_d\times\overline{B}=O$$

then $$\overline{F}=q(\overline{v}-\overline{v}_d)\times\overline{B}$$

Thus, in a new reference system relative to $\overline{v}_d$, the electron is no longer subjected to the magnetic field $\overline{B}$ and its path is therefore a circle. This reasoning made in conventional mechanics remains valid for relativistic mechanics, in particular in the case where $v^2/C2>>1$.

Figure 4:
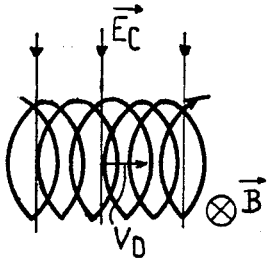
FIG. 4 shows schematically the path of an electron subjected to a continuous electric field $E_c$ and to a magnetic field B.

Consequently, when an electron is subjected to an electric field $\overline{E}$ and a magnetic field $\overline{B}$, the path of an electron is substantially equivalent to the superposition of a rotation with an angular speed given by the equation $$f_c = \frac{e}{2\pi m}\overline{B}.$$

with e=the charge of the electron m=the mass of the electron and of a drift velocity $v_d$ given by the vectorial equation $$\overline{E}+\overline{v}_d\times\overline{B}=O$$

as shown in FIG. 4.

Moreover, in the case of the present invention, since the electrons come from a cathode 1 without having any injection velocity, the speed of rotation is equal to the drift velocity and the following equations are obtained:

$$v_d=E_{co}/B=V/Bd \quad (1)$$

with V: the potential difference between electrodes 2, 3

Since $v_d=v_r$ $$r_L=mE_{co}/eB^2$$

Normally, according to this equation, if $E_c$ decreases $r_L$ decreases accordingly since B is constant in the invention. However, since $E_c$ is a continuous electric field it can be shown that, if the distance d between the two electrodes varies little over the length corresponding to a rotation, we have then so called "adiabatic" operating conditions in which the moment of the electron $m=kBr_L^2=Cste$. In this case, Larmor's radius $r_L$ remains constant and the center of rotation moves along tight circles as shown in FIG. 1, for the drift velocity $v_d$ decreases at the same time as the electric field $E_c$, the equations (1) and (2) remaining valid locally.

So, with the electron gun of the present invention the cycloidal path is obtained required by the new type of cyclothronic maser.

Moreover, if we compare this system with the axial injection system used at present in gyrotrons, it can be seen that the drift velocity $v_d$ plays a role identical to the parallel velocity in said axial system.

If it is desired for example to obtain the relationship $V_d/v_r=2$ at the downstream end of the gun, $v_d$ will have to be reduced in a ratio of 2 along the path of the gun, which will be obtained by progressively increasing the distance between electrodes 2, 3 in a ratio of 2.

Furthermore, anode 3 should be placed above the top of the path of the electrons. The result is that the minimum potential Vmin is given by the equation $$Vmin = 2r_L E_{co} = \frac{2\, mE_{co}^2}{eB^2}$$

Now, the continuous kinetic energy in the rotational movement is $$W_r = \frac{1}{2}\ \frac{m}{e}\ v_r^2 = \frac{1}{2}\ \frac{m}{e}\left(\frac{E_{co}}{B}\right)^2$$

$E_{co}$ being the electric field in front of the cathode. It follows therefrom that anode 3 must then have, with respect to the cathode, a potential at least four times greater than the rotational energy of the electrodes which is useable in the cyclotronic interaction.

Figure 2:
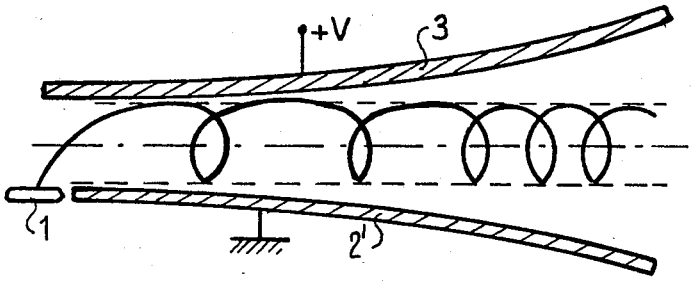
FIG. 2 is a view similar to that of FIG. 1 of a second embodiment of an electron gun for use in the present invention.

In FIG. 2 has been shown another embodiment of the electron gun of which is characteristic the present invention. In this embodiment, the sole 2' has a curved profile symmetrical with that of anode 3 with respect to the median plane, this particular form gives a deflection in a constant direction along the median plane.

Figure 3:
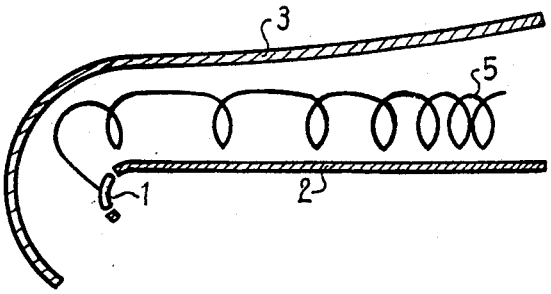
FIG. 3 is a view similar to that of FIG. 1 of a third embodiment of an electron gun for use in the invention.

FIG. 3 shows a variant of FIGS. 1 and 2. In this case, cathode 1 is positioned in the extension of sole 2 but in a plane forming an angle between −45° and −180° with respect to the plane of the sole 2. The anode is then extended by a curved profile so as to overlap the cathode. In this case, the starting velocity of the electrons is opposite in direction to the drift velocity, which allows the potential difference to be applied between anode 3 and cathode 1 to be reduced.

The above described electron guns have a number of advantages.

the drift velocity of electrons can be modified without modifying the magnetic field $\overline{B}$ while only modifying the electric field $\overline{E}_c$.

the electrons cannot return to the region of the gun if they are reflected downstream by the remainder of the device, for the drift velocity $V_d$ is independent in magnitude and sign of the form of the path.

the dimension of the electrodes and of the cathode along the magnetic field $\overline{B}$ is not limited. The result is that very high electron currents can be produced with this type of gun.

In addition, electron guns in accordance with the present invention may be used, not only in the new types of cyclotronic resonance masers mentioned in the introduction but also in ultra-high frequency tubes requiring injection of an electron beam along a cycloidal path.

Reference is made to my related application Ser. No. 595,976 which was filed at the same date as this application, which relates to an ultra-high frequency generator which employs the electron gun described in this application.

What is claimed is:

1. An ultra-high frequency wave generator which includes an electron gun and a collector between which is to be propagated an electron beam along cycloidal paths in a transverse magnetic field and a resonant structure intermediate between the gun and the collector to be traversed by the electron beam characterized in that the electron gun comprises a cathode, and first and second electrodes positioned opposite one another for defining a space therebetween for flow of the electron beam, said electrodes being shaped to provide a steady increase in said space, said cathode being positioned essentially as an extension of the first electrode at its end of minimum spacing from the second electrode.

2. A generator in accordance with claim 1 in which the first electrode is adapted to be maintained at the same potential as the cathode and at a different potential from the second electrode.

3. The wave generator as claimed in claim 1 wherein the profile of said two electrodes in the plane perpendicular to the magnetic field is symmetrical with respect to their median plane.

4. The wave generator as claimed in claim 1 wherein the divergent profile forms an angle with respect to the median plane such that the spacing between said two electrodes varies little over a length corresponding to twice Larmor's radius.

5. A wave generator according to claim 1 wherein the potential difference applied between said two electrodes is at least four times greater than the rotational energy of the electrons.

6. The wave generator as claimed in claim 1 wherein said cathode is positioned in the extension of said first electrode in a plane forming an angle between −45° and −180° with respect to the plane of the first electrode so as to communicate to the electrons a starting velocity opposite in the direction to the drift velocity.

* * * * *